US007712231B2

(12) United States Patent
Umezawa et al.

(10) Patent No.: US 7,712,231 B2
(45) Date of Patent: May 11, 2010

(54) SHOE

(75) Inventors: Ikuko Umezawa, Kobe (JP); Tetsuo Yamaguchi, Kobe (JP); Kunio Niwa, Kobe (JP); Toshihiro Horii, Kobe (JP); Koichi Fujisawa, Kobe (JP)

(73) Assignee: SRI Sports Limited, Kobe (JP)

( * ) Notice: Subject to any disclaimer, the term of this patent is extended or adjusted under 35 U.S.C. 154(b) by 332 days.

(21) Appl. No.: 11/505,338

(22) Filed: Aug. 17, 2006

(65) Prior Publication Data

US 2007/0107258 A1 May 17, 2007

(30) Foreign Application Priority Data

Nov. 17, 2005 (JP) ..... 2005-332893

(51) Int. Cl.
*A43B 13/12* (2006.01)

(52) U.S. Cl. ..... 36/142; 36/144; 36/30 R

(58) Field of Classification Search ..... 36/142–144, 36/44, 25 R, 30 R, 31
See application file for complete search history.

(56) References Cited

U.S. PATENT DOCUMENTS 2,052,115 A * 8/1936 Shulman ..... 36/144
3,738,373 A * 6/1973 Glancy ..... 36/144
4,642,911 A * 2/1987 Talarico, II ..... 36/30 R
5,881,478 A * 3/1999 McMahon et al. ..... 36/144
6,474,006 B1 * 11/2002 Cummings et al. ..... 36/142
7,191,552 B1 * 3/2007 Husom ..... 36/144
2003/0033733 A1 * 2/2003 Brooks ..... 36/31

FOREIGN PATENT DOCUMENTS

JP 2-134003 U 11/1990

* cited by examiner

*Primary Examiner*—Marie Patterson
(74) *Attorney, Agent, or Firm*—Birch, Stewart, Kolasch & Birch, LLP

(57) ABSTRACT

A midsole of a shoe has a low elastic part 20, a high elastic part 22 and an inclined surface 24. The low elastic part 20 and the high elastic part 22 include air bubbles. An ethylene-vinyl acetate copolymer (EVA) is used as a base polymer in the low elastic part 20 and the high elastic part 22. The inclined surface 24 is inclined upward from the inside to the outside. The low elastic part 20 is located to the inside of the inclined surface 24. The high elastic part 22 is located to the outside of the inclined surface 24. An inner high elastic part 26 is located to the inside of a low elastic part 20. The thickness of the low elastic part 20 becomes gradually larger from the outside to the inside along the inclined surface 24. The thickness of the high elastic part 22 becomes gradually larger from the inside to the outside along the inclined surface 24. The width Wa of the inclined surface 24 in left and right direction is 5 mm or more and 100 mm or less.

16 Claims, 16 Drawing Sheets

SHOE

This application claims priority based on Japanese Patent Application No. 2005-332893 filed on Nov. 17, 2005. All the contents in the Japanese Patent Application are hereby incorporated by reference.

BACKGROUND OF THE INVENTION

1. Field of the Invention

The present invention relates to shoes suitable for golf, tennis, squash, field hockey, basketball, aerobic exercise or the like.

2. Description of the Related Art

A shoe comprises an outsole, midsole, insole, upper or the like. A midsole comprises a polymer form including air bubbles. As a base polymer, ethylene-vinyl acetate copolymer (EVA) is used for a normal midsole. A midsole contributes to shock absorbability. JP-U-H2-134003 discloses a shoe comprising a multilayer-structured midsole and being superior in shock absorbability and traction.

When hitting a golf ball, a golf player sets an address such that a line connecting the right and the left is almost parallel with a the hitting direction. At the address, the head of a golf club is positioned close to the golf ball. The golf player starts the take-back, pulls the golf club head backward and then swings the golf club upward. The highest position of the head swung upward is referred to as the "top position". From the top position, the down swing is started and the golf club head is swung downward so that the head impacts the golf ball. After the impact, the golf player swings the right-handed golf club leftward, then follows and finally finishes.

From the top position to the finish, the golf player turns the body by setting the left foot as a pivot. At the same time, the golf player kicks the ground with the right foot to transfer the force to the golf ball. In other words, a right-handed golf player uses the left foot as a pivoting foot and the right foot as a kicking foot. A left-handed golf player uses the right foot as a pivoting foot and the left foot as a kicking foot.

During the swing, the golf player kicks the ground while applying his or her own body weight to the inside of the kicking foot. The golf player receives his or her own body weight mainly on the inside of the pivoting foot. At this time, force is transferred to the ground via the shoe. A shoe suitable for a golf swing is desired.

Also in various sports, a movement in which a player's body weight is applied to the inside of a foot is observed. In tennis and squash, when a racket is swung, a player's body weight is applied to the inside of a foot. In field hockey, when a stick is swung, a player's body weight is applied to the inside of a foot. In basketball and aerobics exercise, a player's body weight is applied to the inside of a foot during both clockwise and anticlockwise body turns. In these sports, a shoe suitable for movement is desired.

The object of the present invention is to provide a shoe in which a wearer's body weight is easily applied to the inside of a foot.

SUMMARY OF THE INVENTION

A shoe according to the present invention comprises a bottom part. When the body weight of a wearer is applied to the top surface of the bottom part, downward displacement of the inside of the top surface is larger than downward displacement of the outside of the top surface.

In the shoe according to the present invention, when the body weight is applied, the top surface of the bottom part is inclined upward from the inside to the outside. This inclination enables the wearer to apply the body weight to the inside of the foot more easily.

Another shoe according to the present invention comprises a bottom part including a midsole. This midsole has a low elastic part, a high elastic part and an inclined surface. There is a low elastic part to the inside of the inclined surface and there is a high elastic part to the outside of the inclined surface. When the body weight of a wearer is applied to the top surface of this bottom part, downward displacement of the inside of the top surface is larger than downward displacement of the outside of the top surface.

It is preferable that there is a high elastic part to the inside of the low elastic part. It is preferable that the thickness of the low elastic part becomes gradually larger along the inclined surface in the direction from the outside to the inside. It is preferable that the thickness of the high elastic part becomes gradually larger along the inclined surface in the direction from the inside to the outside. It is preferable that the above-mentioned inclined surface exists at a place of 25% from the tiptoe end toward the heel end. It is preferable that the width of the inclined surface in the left and right directions is 5 mm or more and 100 mm or less. It is preferable that the maximum thickness along the inclined surface of the low elastic part is 30% or more of the thickness of the midsole. It is preferable that the inclined surface is inclined upward in the direction from the inside to the outside. It is preferable that the ratio (HL/HH) of the hardness HL of the above-mentioned low elastic part to the hardness HH of the above-mentioned high elastic part is 0.20 or more and 0.90 or less.

DESCRIPTION OF THE PREFERRED EMBODIMENTS

The present invention will be described below in detail based on a preferred embodiment with reference to the drawings.

Figure 1:
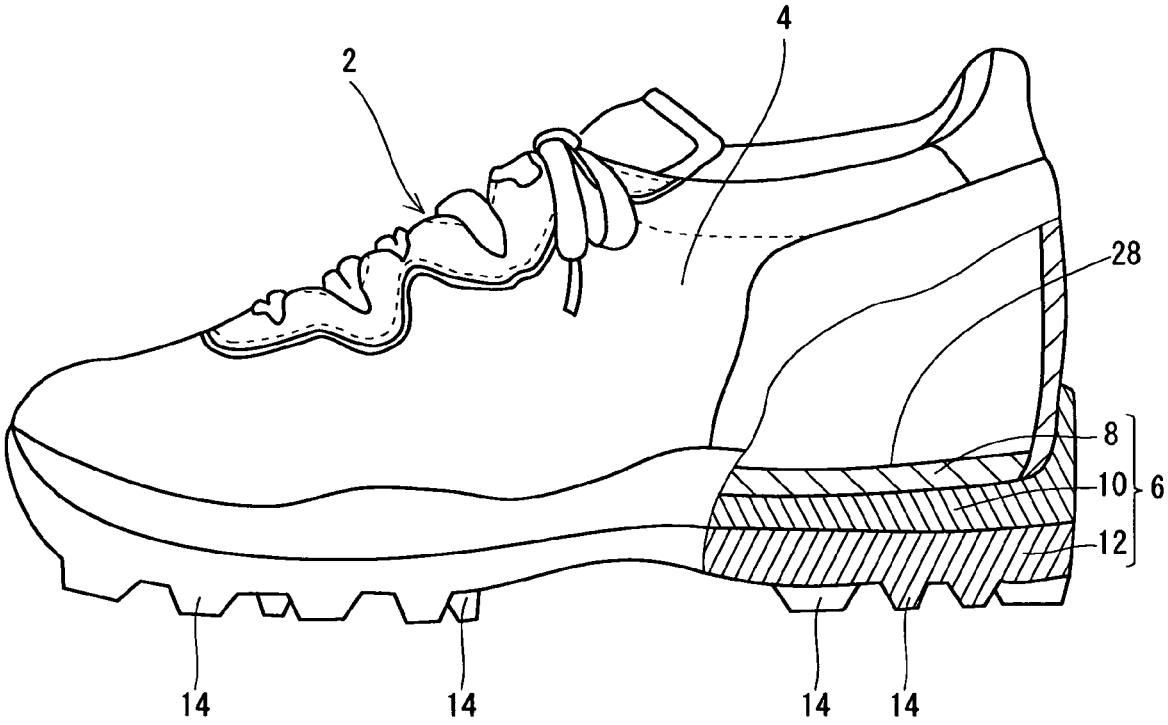
FIG. 1 is a partially-cutout side view showing a golf shoe according to an embodiment of the present invention.

A golf shoe 2 illustrated in FIG. 1 comprises an upper 4 and a bottom part 6. The bottom part 6 has an insole 8, a midsole 10 and an outsole 12. The insole 8 is laminated with the midsole 10. The midsole 10 is laminated with the outsole 12. The outsole 12 has a number of projections 14 protruding downward on the lower surface. The material and structure for the upper 4 are equal to those of known upper. The material and structure for the insole 8 are equal to those of known insole. The material and structure for the outsole 12 are equal to those of known outsole.

Figure 2:
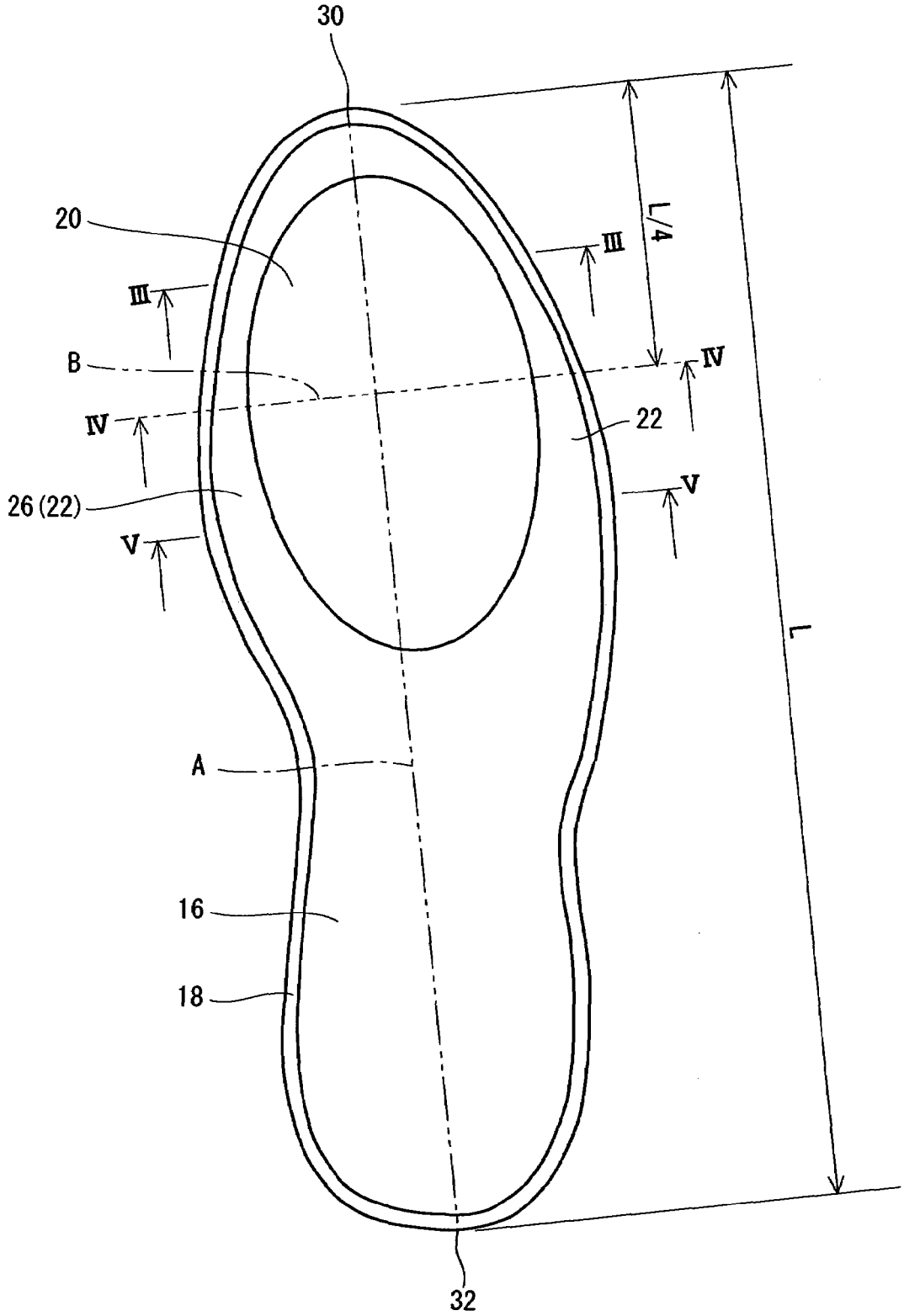
FIG. 2 is a plan view showing a midsole of a golf shoe illustrated in FIG. 1.
Figure 3:
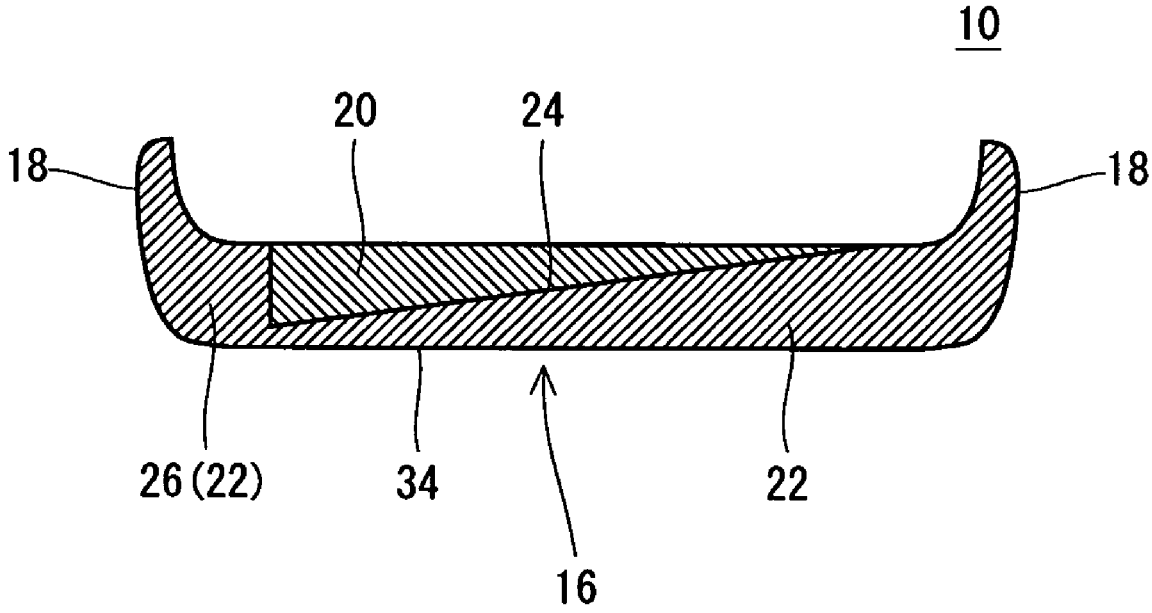
FIG. 3 is an expanded cross-sectional view taken along the line III-III in FIG. 2
Figure 4:
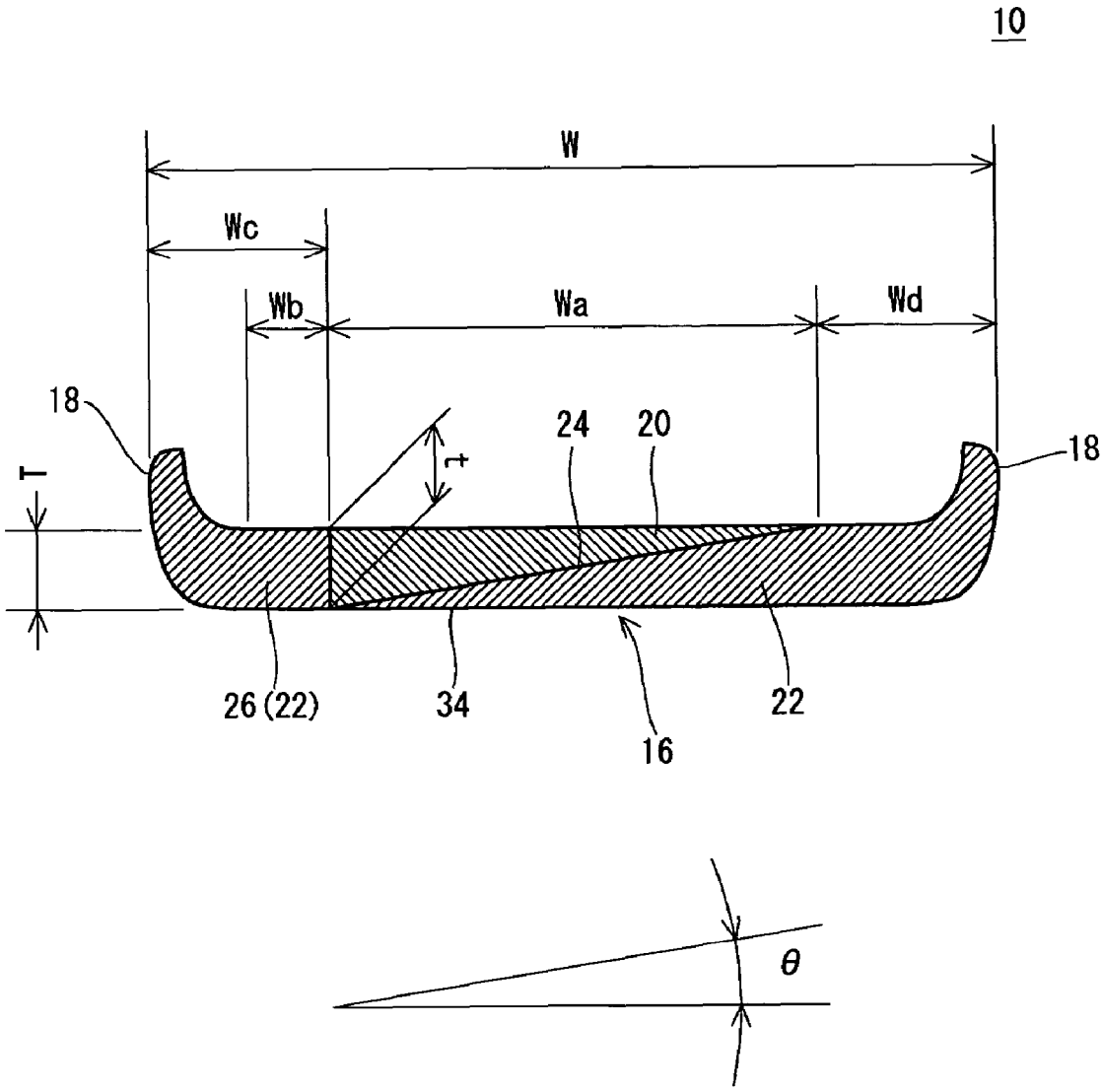
FIG. 4 is an expanded cross-sectional view taken along the line IV-IV in FIG. 2.
Figure 5:
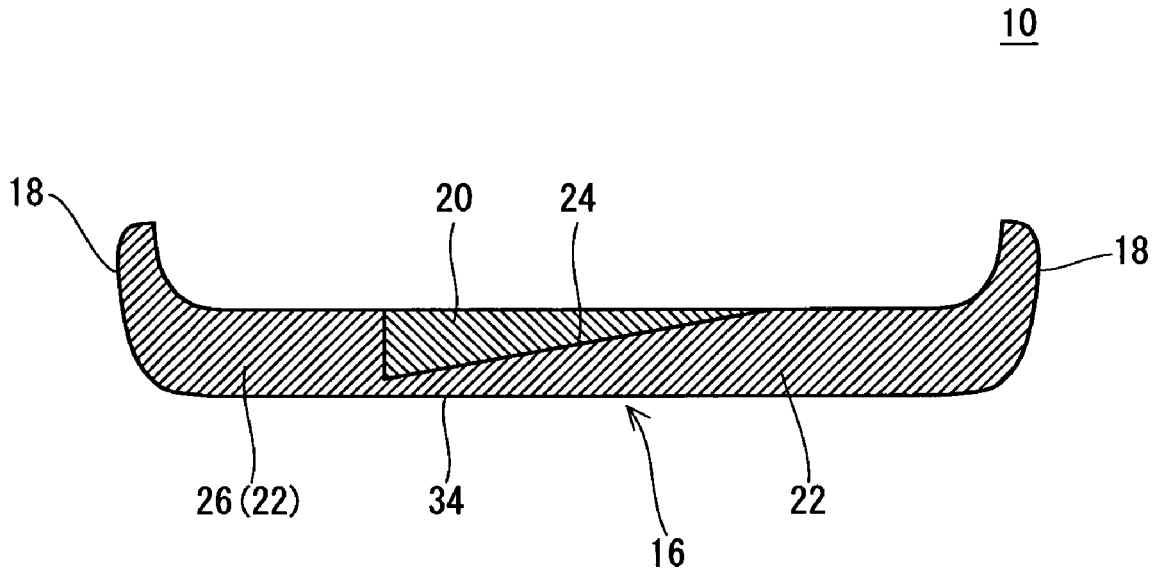
FIG. 5 is an expanded cross-sectional view taken along the line V-V in FIG. 2.

As shown in FIG. 2 to FIG. 5, the midsole 10 has a base 16 and a side wall 18 which is located on the outer edge of this base 16. This midsole 10 is designed for a right foot. The shape of the midsole for a left foot is a mirror-reversed shape of the shape illustrated in FIG. 2. In FIG. 3 to FIG. 5, the left side direction indicates an inside direction and the right side direction indicates an outside direction.

The midsole 10 comprises a polymer form including air bubbles. A typical base polymer of the midsole 10 is an ethylene-vinyl acetate (EVA). A vinyl acetate content of EVA is preferably 10 mass % or more and more preferably 15 mass % or more. The vinyl acetate content of EVA is preferably 40 mass % or less, more preferably 30 mass % or less and particularly preferably 25 mass % or less. It is preferable that an EVA and a polyolefin are used in combination as a base polymer for the midsole. The polyolefin contributes to shock absorbability and rebound performance. From this point, the amount of polyolefin to the total amount of the base polymer is preferably 5 mass % or more and more preferably 10 mass % or more. From the cost and adhesive performance standpoints, the amount of polyolefin is preferably 80 mass % or less, more preferably 70 mass % or less and particularly preferably 15 mass % or less. The preferable polyolefin include an ethylene-octane copolymer, an ethylene-butene copolymer, polypropylene and a polyethylene.

The midsole 10 may include independent air bubbles or may include continuous air bubbles. From the view point of the shape recovery force and non-absorption property, it is preferable that independent air bubbles are included. Air bubbles are formed in general by foaming of thermally-decomposed foaming agent. As a thermally-decomposed foaming agent, an azo compound (for example, an azodicarbonamide), nitroso compound (for example, dinitrosopentamethylenetetramine) and a triazole compound are shown. An expansion rate of the midsole 10 is preferably 2 times or more and more preferably 3 times or more. Furthermore, the expansion rate is preferably 30 times or less, more preferably 15 times or less and particularly preferably 10 times or less.

This midsole 10 has a low elastic part 20 and a high elastic part 22. The elastic modulus of the low elastic part 20 is lower than that of the high elastic part 22. When a compression load is applied to the midsole 10, the low elastic part 20 is more easily deformed than the high elastic part 22. The low elastic part 20 may comprise two (2) or more parts having different elastic moduli. The high elastic part 22 may comprise two (2) or more parts having different elastic moduli.

Furthermore, this midsole 10 has an inclined surface 24. The inclined surface 24 forms a part of a boundary between the low elastic part 20 and the high elastic part 22. The inclined surface 24 is inclined along the horizontal directions. In this embodiment, the inclined surface 24 is inclined upward from the left (the inside) to the right (the outside). The low elastic part 20 is located on the upper side of the inclined surface 24. The low elastic part 20 is located to the inside of the inclined surface 24. The high elastic part 22 is located to the lower side of the inclined surface 24. The high elastic part 22 is located to the outside of the inclined surface 24. The high elastic part 22 is also located to the inside of the low elastic part 20. A high elastic part 22 which is located to the inside of the low elastic part 20 is hereinafter referred to as "inner high elastic part 26". The thickness of the low elastic part 20 becomes gradually larger along the inclined surface 24 from the outside to the inside. The thickness of the high elastic part 22 becomes gradually larger along the inclined surface 24 from the inside to the outside.

When a golf player wears these golf shoes 2 and the body weight of the golf player is applied to the bottom part 6, this midsole 10 is compressed. Since the thickness of the low elastic part 20 is larger in the inside, the inside compression deformation is larger. Since the thickness of the high elastic part 22 is larger in the outside, outside compression deformation is smaller. In this midsole 10, applying the body weight generates unbalanced deformation. Deformation of the midsole 10 displaces the position of an upper surface 28 (FIG. 1) of the insole 8. The downward displacement of the upper surface 28 in the inside is larger than the downward displacement of the upper surface 28 in the outside. The insole 8 inclines upward from the inside to the outside. The foot of a golf player also inclines upward from the inside to the outside. The body weight of a golf player is mainly applied to the inside. As mentioned above, when a golf player swings, the golf player kicks the ground with the inside of the kicking foot. Since the foot is inclined, the golf player easily transfers the force to the ground. This midsole 10 is suitable for the right foot of a right-handed golf player. These golf shoes 2 contribute to generation of high head speed. The large head speed generates a long flight distance.

Even if the body weight of a golf player is applied to the bottom part 6, the inner high elastic part 26 is not deformed so much. This inner high elastic part 26 does not absorb a force transferred from the foot to the ground so much. A large amount of force is transferred from the foot to the ground through this inner high elastic part 26. This inner high elastic part 26 contributes to generation of great head speed.

A midsole having a mirror-reversed shape of the midsole in FIG. 3 is suitable for a pivoting foot of a right-handed golf player (that is, the left foot). This midsole inclines the pivoting foot of the golf player upward from the inside to the outside. The gold player tends to receive the body weight on the pivoting foot. This midsole also contributes to long flight distance.

In the present invention, the state where the body weight is applied on means that the state where a wearer whose weight is 60 kg applies the weight to the right and left feet uniformly.

It is preferable that unbalanced deformation is achieved in both the midsole for the left foot and the midsole for the right foot. The unbalanced deformation may be achieved in either the midsole for the left foot or the midsole for the right foot.

In this midsole 10, thickness of the low elastic part 20 and high elastic part 22 gradually changes along the inclined surface 24. Accordingly, the compression deformation in the midsole 10 changes continuously along the inclined surface 24 from the inside to the outside. The compression deformation does not change rapidly. The continuous change contributes to stability of swing. A stable swing suppresses variation of flight distance. Furthermore, a stable swing suppresses variation of flight direction of a golf ball. The midsole 10 whose compression deformation changes continuously does not cause discomfort during walking.

By applying large expansion rate to the low elastic part 20 and small expansion rate to the high elastic part 22, a difference between elastic moduli can be achieved. By using a base polymer for the high elastic part 22 and another base polymer for the low elastic part 20, a difference between elastic moduli can be achieved By adding an amount of an additive agent which is different from the amount of the high elastic part 22 into the low elastic part 20, a difference between elastic moduli can be achieved. By mixing an additive agent into the low elastic part 20 and another additive agent into the high elastic part 22, a difference between elastic moduli can be achieved.

As clearly shown in FIG. 2, the planar shape of the low elastic part 20 is substantially ellipse. In the midsole 10 having the elliptical low elastic part 20, the compression deformation does not change rapidly even in a back and forth direction. The elliptical low elastic part 20 contributes to stability of swing. A low elastic part whose planar shape is elongated circle also contributes to stability of swing.

A chain double-dashed line designated by a reference numeral A in FIG. 2 is a longitudinal line of the midsole 10. The longitudinal line A is the longest segment that can be drawn within a contour of the midsole 10. The longitudinal line A extends from the tiptoe end 30 to the heel end 32. In FIG. 2, the length of the longitudinal line A is designated by a reference numeral L. A chain double-dashed line designated by a reference numeral B in FIG. 2 is a lateral line. The lateral line B is at right angles to the longitudinal line A. The distance from the tiptoe end 30 to the lateral line B is (L/4). The lateral line B passes through the low elastic part 20. In other words, the inclined surface 24 is located at the place of 25% of the distance L from the tiptoe end 30 to the heel end 32 along the longitudinal line A. The position to which the maximum loads are applied during swinging is the vicinity of the ball of the thumb. The inclined surface 24 is located on the above-mentioned position, which allows a golf player to transfer the force to the ground easily. The length L is from 150 mm to 320 mm in general.

From the point of view that the force is easily transferred to the ground by a golf player, the distance of the inclined surface 24 along the longitudinal line A is preferably 5 mm or more, more preferably 20 mm or more, and particularly preferably 50 mm or more. From the effect standpoint, the upper limit of this distance is not designated. However, it is usually 200 mm or less, or furthermore, 105 mm or less.

The length designated by both-oriented arrow Wa in FIG. 4 is the width of the inclined surface 24 in the left and right directions. The width Wa is measured on a cross-section surface along the lateral line B. The width Wa is preferably 5 mm or more and 100 mm or less. By setting the width Wa to be 5 mm or more, rapid change of compression deformation is suppressed. From this viewpoint, the width Wa is more preferably 20 mm or more and particularly preferably 30 mm or more. In the golf shoes 2 whose width Wa is set to be 100 mm or less, a golf player transfers the force to the ground easily. From this viewpoint, the width Wa is more preferably 80 mm or less and particularly preferably 70 mm or less. The width W of the midsole 10 along the lateral line B is 80 mm or more and 120 mm or less in general.

The length designated by both-oriented arrow Wb in FIG. 4 is a width of a flat top surface of the inner high elastic part 26. The width Wb is measured along the lateral line B. The width Wb is preferably 3 mm or more and 25 mm or less. By setting the width Wb to be 3 mm or more, sufficient force is transferred from the foot to the ground. From this viewpoint, the width Wb is more preferably 5 mm or more, still more preferably 7 mm or more and particularly preferably 10 mm or more. By setting the width Wb to be 25 mm or less, the foot is sufficiently inclined. From this viewpoint, the width Wb is more preferably 22 mm or less and particularly preferably 18 mm or less.

The length designated by both-oriented arrow Wc in FIG. 4 is a width of the inner high elastic part 26. The width Wc is measured along the lateral line B. The width Wc is preferably 13 mm or more and 35 mm or less. By setting the width Wc to be 13 mm or more, sufficient force is transferred from the foot to the ground. From this viewpoint, the width Wc is more preferably 15 mm or more, still more preferably 17 mm or more and particularly preferably 20 mm or more. By setting the width Wc to be 35 mm or less, the foot is sufficiently inclined. From this viewpoint, the width Wc is more preferably 32 mm or less and particularly preferably 28 mm or less.

The length designated by both-oriented arrow Wd in FIG. 4 is a distance between the outside end of the low elastic part 20 and the outside end of the midsole. The distance Wd is preferably 13 mm or more, more preferably 15 mm or more, still more preferably 17 mm or more and particularly preferably 20 mm or more. The distance Wd is preferably 35 mm or less, more preferably 32 mm or less and particularly preferably 28 mm or less.

The length designated by both-oriented arrow T in FIG. 4 is the thickness of the midsole 10. The thickness T is measured on a cross-section surface along the lateral line B. The thickness T is the maximum thickness among the parts except for the side wall 18. The thickness T is preferably 2 mm or more and more preferably 5 mm or more. The thickness T is preferably 25 mm or less, more preferably 20 mm or less and particularly preferably 15 mm or less. The length designated by both-oriented arrow t in FIG. 4 is the maximum thickness of the low elastic part 20. The thickness t is measured on a cross-section surface along the lateral line B. From the viewpoint that the top surface of the insole 8 is sufficiently inclined, the ratio of the thickness t to the thickness T is preferably 30% or more, more preferably 40% or more, still more preferably 50% or more, and particularly preferably 80% or more. In the embodiment shown in FIG. 4, this ratio is designed to be 100%. In other words, the low elastic part 20 is slightly exposed on the bottom surface 34 of the midsole 10. FIG. 3 clearly shows that the low elastic part 20 is not exposed on the bottom surface 34 on a cross-section surface along III-III line. FIG. 5 clearly shows that the low elastic part 20 is not exposed on the bottom surface 34 on a cross-section surface along V-V line.

If there is a boundary between the low elastic part 20 and the high elastic part 22 on the bottom surface 34, this boundary may cause damage such as a crack or the like. From the standpoint of durability of the midsole 10, it is preferable that there is no boundary on the bottom surface 34. In other words, it is preferable that the low elastic part 20 is not exposed on the bottom surface 34. From the standpoint of durability, the ratio of the thickness t to the thickness T is preferably less than 100%, more preferably 98% or less and particularly preferably 95% or less.

The angle designated by both-oriented arrows θ in FIG. 4 is the angle of the inclined surface 24 to the left and right directions (horizontal direction). The angle θ is measured on a cross-sectional surface along the lateral line B. The angle θ is preferably 3 degrees or more and 60 degrees or less. In the golf shoes 2 whose angle θ is set to be 3 degrees or more, a force can be easily transferred to the ground by a golf player. From this viewpoint, the angle θ is more preferably 5 degrees or more and particularly preferably 7 degrees or more. By setting the angle θ to be 60 degrees or less, rapid change in compression deformation is suppressed. From this viewpoint, the angle θ is more preferably 50 degrees or less, more preferably 40 degrees or less and particularly preferably 20 degrees or less.

The ratio (HL/HH) of the hardness HL of the low elastic part 20 to the hardness HH of the high elastic part 22 is preferably 0.20 or more and 0.90 or less. By setting the ratio (HL/HH) to be 0.20 or more, rapid change in compression deformation can be suppressed. From this viewpoint, the ratio (HL/HH) is more preferably 0.3 or more and particularly preferably 0.40 or more. By setting the ratio (HL/HH) to be 0.90 or less, a force can be easily transferred to the ground by a golf player. From this viewpoint, the ratio (HL/HH) is more preferably 0.85 or less and particularly preferably 0.80 or less. The hardness HL of the low elastic part 20 is preferably 20 or more and 70 or less. The hardness HH of the high elastic part 22 is preferably 40 or more and 85 or less. The hardness in conformity to the Society of Rubber Industry, Japan Standard is measured by an Asker C hardness meter of Kobunshi Keiki Co., Ltd.

Figure 6:
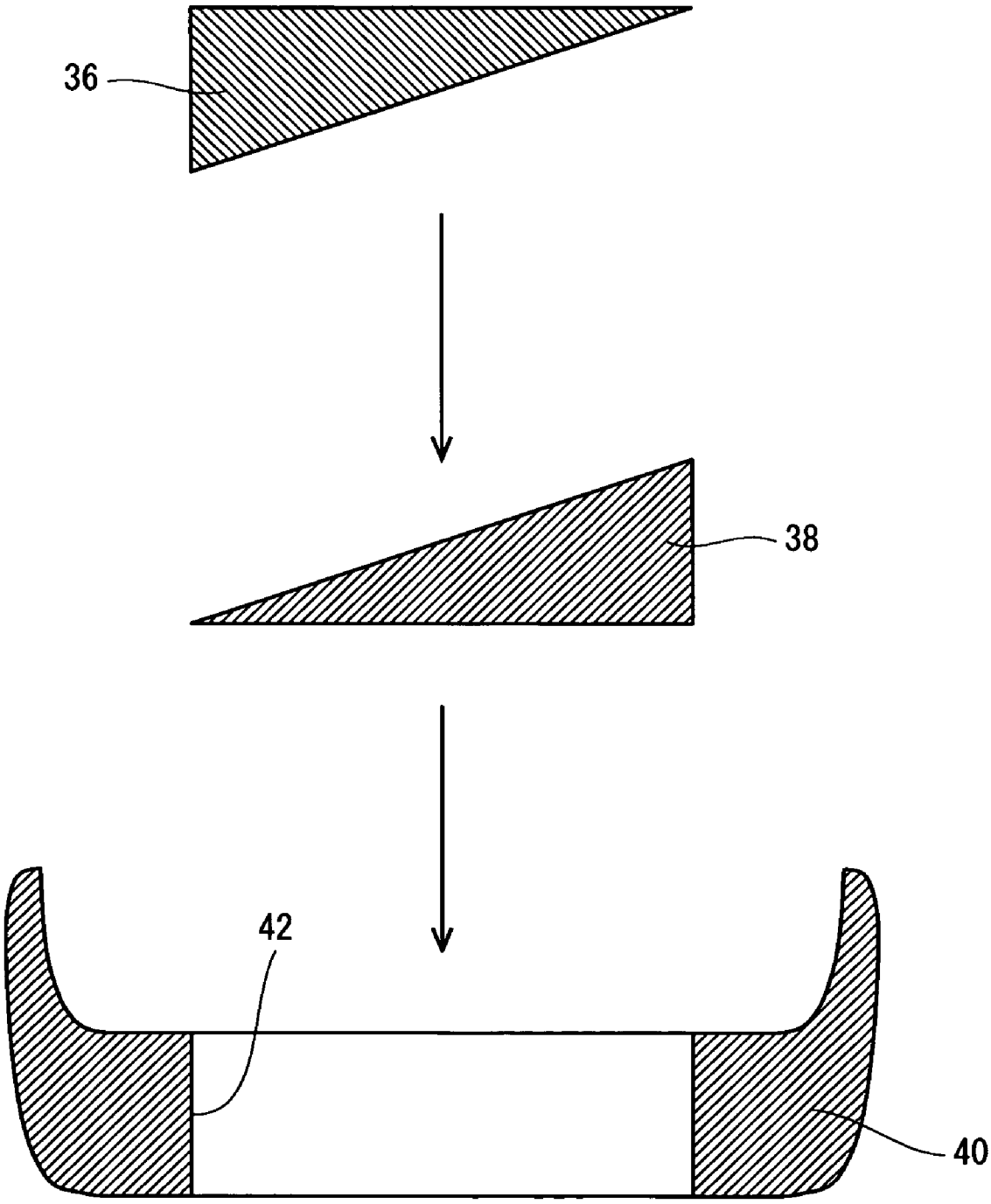
FIG. 6 is a cross-sectional view explaining an example of a manufacturing method of the midsole illustrated in FIG. 2.

FIG. 6 is a cross-sectional view explaining an example of a manufacturing method for the midsole 10 in FIG. 2. In this manufacturing method, a first component 36, a second component 38 and a third component 40 are prepared. Each of the first component 36, the second component 38 and the third component 40 is polymer former including air bubbles. The elastic modulus of the first component 36 is smaller than that of the second component 38 and the third component 40. The cross-sectional shape of the first component 36 and the second component 38 is substantially a triangle. The contour of the third component 40 is similar to that of the midsole 10. The third component 40 has a hole 42 formed by blanking.

In this manufacturing method, the first component 36 is attached to the second component 38. The boundary between the first component 36 and the second component 38 is inclined. Next, the first component 36 and the second component 38 are inserted into the hole 42 of the third component 40. Next, the first component 36, the second component 38 and the third component 40 are placed into a mold and compressed under high temperature. Each component 36, 38 and 40 is joined with each other. In this manufacturing method, the first component 36 forms the low elastic part 20 and the second component 38 and the third component 40 form the high elastic part 22. After the first component 36 and the second component 38 are compressed, and the third component 40 is also compressed, the first component 36 and the second component 38 may be inserted into this third component 40.

Figure 7:
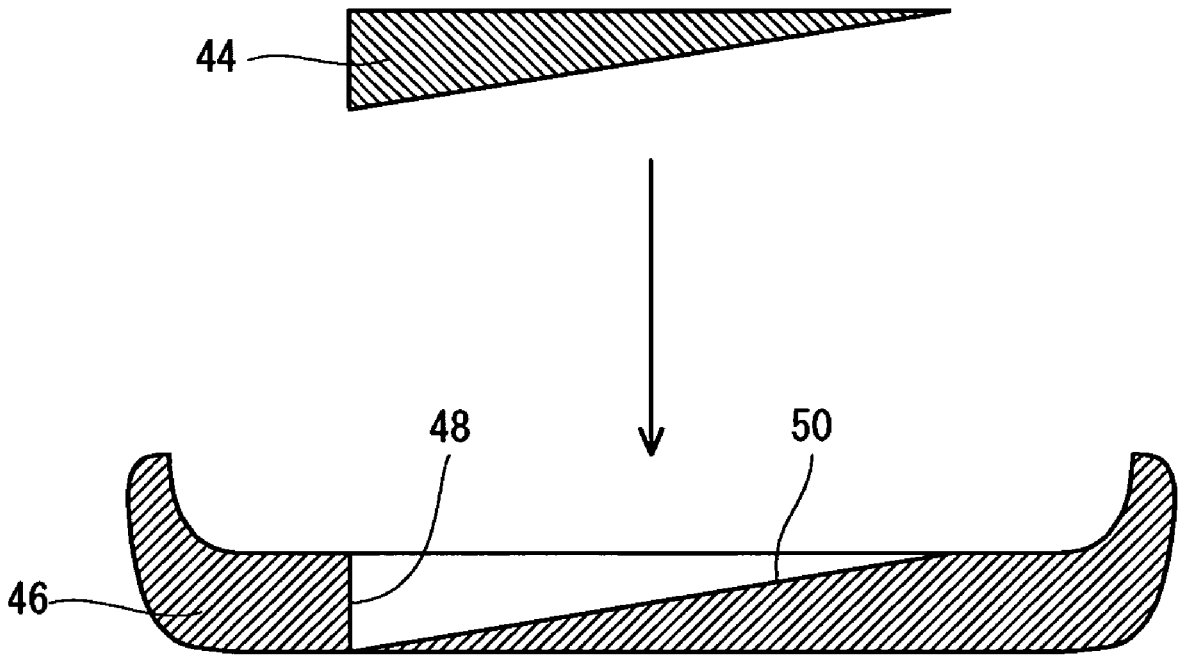
FIG. 7 is a cross-sectional view explaining another example of a manufacturing method of the midsole illustrated in FIG. 2.

FIG. 7 is a cross-sectional view explaining another example of a manufacturing method of the midsole 10 in FIG. 2. In this method, a first component 44 and a second component 46 are prepared. Each of the first component 44 and the second component 46 is a polymer former including air bubbles. The first component 44 and the second component 46 are already compressed. The elastic modulus of the first component 44 is smaller than that of the second component 46. The cross-sectional shape of the first component 44 is substantially a triangle. The contour of the second component 46 is similar to that of the midsole 10. The second component 46 has a recessed part 48. The cross-sectional shape of the recessed part 48 is virtually a triangle. The top surface 50 of the recessed part 48 is inclined.

In this manufacturing method, the first component 44 is inserted into the recessed part 48 of the second component 46 and both components are attached. The boundary between the first component 44 and the second component 46 is inclined. In this manufacturing method, the first component 44 forms the low elastic component 20 and the second component 46 forms the high elastic component 22.

By providing the outsole 12 with a low elastic part and a high elastic part, inclination of a foot may be achieved. By designing the density of the projection 14 in the inside smaller than the density of the projection 14 in the outside, inclination of a foot may be achieved.

Figure 8:
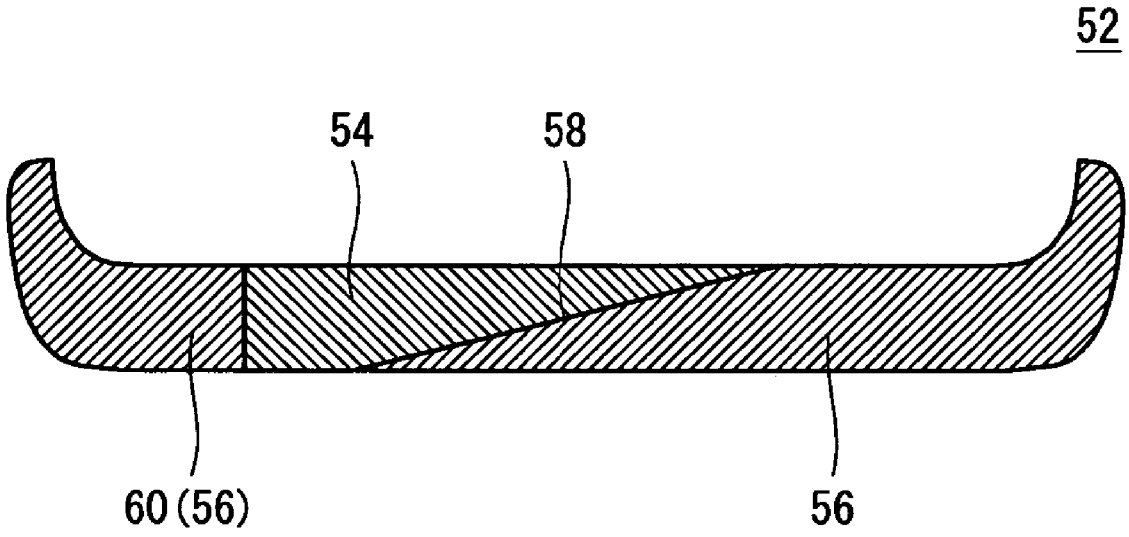
FIG. 8 is a cross-sectional view showing a midsole of a golf shoe according to a further embodiment of the present invention.

FIG. 8 is a cross-sectional view showing a midsole 50 of a golf shoe according to another embodiment of the present invention. The planar shape of this midsole 50 is equal to that of the midsole 10 shown in FIG. 2. FIG. 8 shows a cross-sectional surface along the lateral line B. In FIG. 8, the left side direction indicates an inside direction and the right side direction indicates an outside direction. This midsole 50 has a low elastic part 54, a high elastic part 56 and an inclined surface 58. The cross-sectional shape of the low elastic part 54 is substantially trapezoidal. The lower elastic part 54 is located to the upper side of the inclined surface 58. The lower elastic part 54 is located to the inside of the inclined surface 58. The high elastic part 56 is located to the lower side of the inclined surface 58. The high elastic part 56 is located to the outside of the inclined surface 58. An inner high elastic part 60 is located to the inside of the low elastic part 54.

Also in this midsole 50, a foot is inclined due to a difference of compression deformation of the low elastic part 54 and the high elastic part 56. Through this inclination, a golf player can transfer sufficient force to the ground. Also in this midsole 50, compression deformation changes continuously from the inside to the outside along the inclined surface 58. The continuous change contributes to stability of swing. The inner high elastic part 60 does not absorb much of the force transferred from a foot to the ground.

Figure 9:
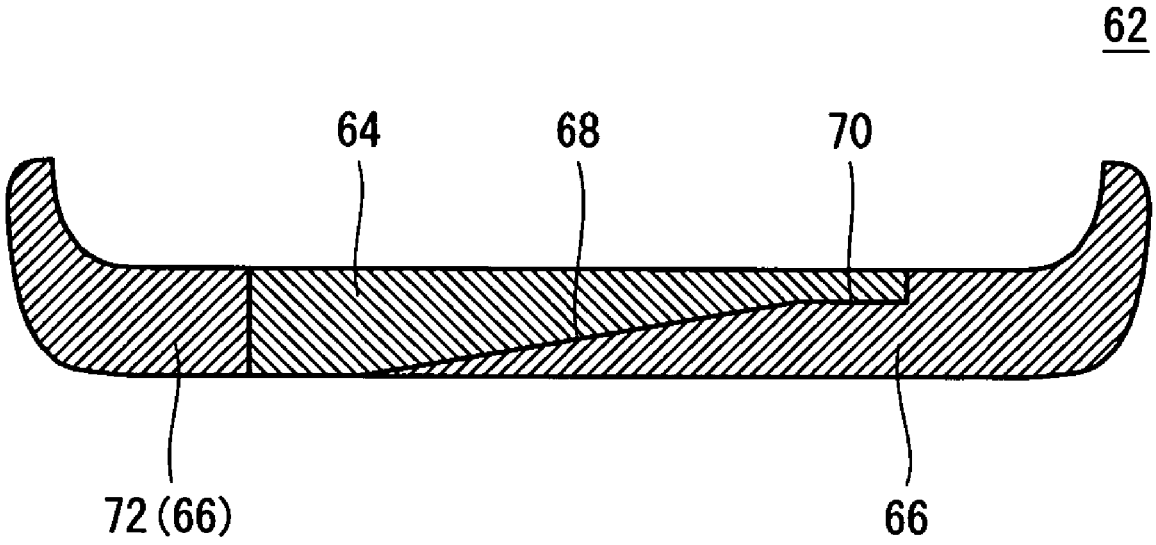
FIG. 9 is a cross-sectional view showing a midsole of a golf shoe according to a further embodiment of the present invention.

FIG. 9 is a cross-sectional view showing a midsole 62 of a golf shoe according to a further embodiment of the present invention. The planar shape of this midsole 62 is equal to that of the midsole 10 shown in FIG. 2. FIG. 9 shows a cross-sectional surface along the lateral line B. In FIG. 9, the left side direction indicates an inside direction and the right side direction indicates an outside direction. This midsole 62 has a low elastic part 64, a high elastic part 66, an inclined surface 68 and a flat surface 70. The flat surface 70 is continuously connected to the inclined surface 68 and is located to the outside of the inclined surface 68. The low elastic part 64 is located to the upper side of the inclined surface 68. The low elastic part 64 is located to the inside of the inclined surface 68. The high elastic part 66 is located to the lower side of the inclined surface 68. The high elastic part 66 is located to the outside of the inclined surface 68. The low elastic part 64 is on the flat surface 70. The high elastic part 66 is under the flat surface 70. An inner high elastic part 72 is located to the inside of the low elastic part 64.

Also in this midsole 62, a foot is inclined due to a difference of compression deformation between the low elastic part 64 and the high elastic part 66. Through this inclination, a golf player can transfer sufficient force to the ground. Also in this midsole 62, the compression deformation changes continuously from the inside to the outside along the inclined surface 68. The continuous change contributes to stability of swing.

Also in this midsole 62, the inner high elastic part 72 does not absorb much of the force transferred from a foot to the ground.

Figure 10:
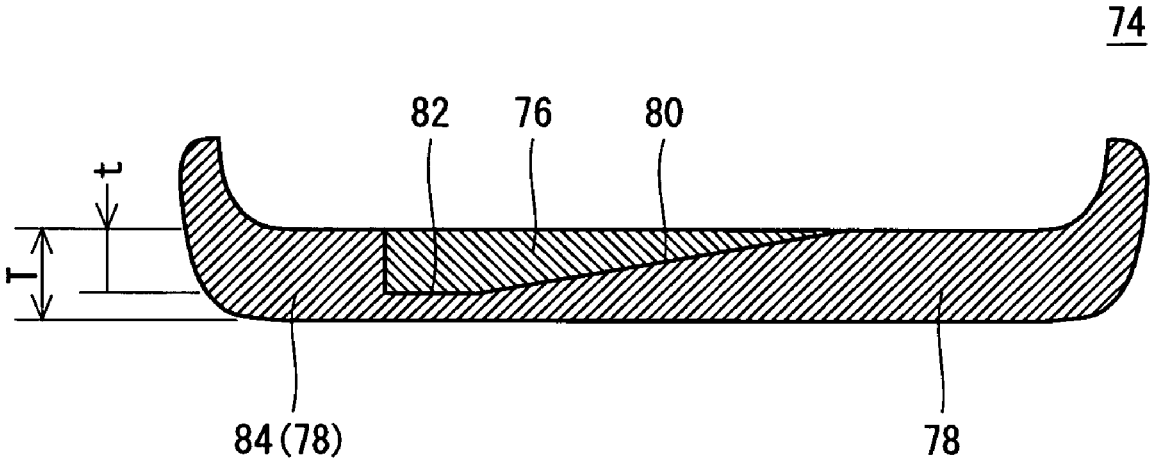
FIG. 10 is a cross-sectional view showing a midsole of a golf shoe according to a further embodiment of the present invention.

FIG. 10 is a cross-sectional view showing a midsole 74 of a golf shoe according to a further embodiment of the present invention. The planar shape of this midsole 74 is equal to that of the midsole 10 shown in FIG. 2. FIG. 10 shows a cross-sectional surface along the lateral line B. In FIG. 10, the left side direction indicates an inside direction and the right side direction indicates an outside direction. The midsole 74 has a low elastic part 76, a high elastic part 78, an inclined surface 80 and a flat surface 82. The flat surface 82 is continuously connected to the inclined surface 80 and is located to the inside of the inclined surface 80. The low elastic part 76 is located to the upper side of the inclined surface 80. The low elastic part 76 is located to the inside of the inclined surface 80. The high elastic part 78 is located to the lower side of the inclined surface 80. The high elastic part 78 is located to the outside of the inclined surface 80. The low elastic part 76 is on the flat surface 82. The high elastic part 78 is under the flat surface 82. An inner high elastic part 84 is located to the inside of the low elastic part 76.

Also in this midsole 74, a foot is inclined due to a difference of compression deformation between the low elastic part 76 and the high elastic part 78. Through this inclination, a golf player can transfer sufficient force to the ground. Also in this midsole 74, compression deformation changes continuously from the inside to the outside along the inclined surface 80. The continuous change contributes to stability of swing. Also in this midsole 74, the inner high elastic part 84 does not absorb much of the force transferred from a foot to the ground.

In this midsole 74, the low elastic part 76 is not exposed on the bottom surface. In other words, the boundary between the low elastic part 76 and the high elastic part 78 does not exist on the bottom surface. This midsole is superior in durability. From the standpoint of durability, the ratio of the thickness t of the low elastic part 76 to the thickness T of the midsole 74 is preferably less than 100%, more preferably 98% or less and particularly preferably 95% or less. From the viewpoint that the top surface of the insole is sufficiently inclined, this ratio is preferably 30% or more, more preferably 50% or more and particularly preferably 80% or more.

Figure 11:
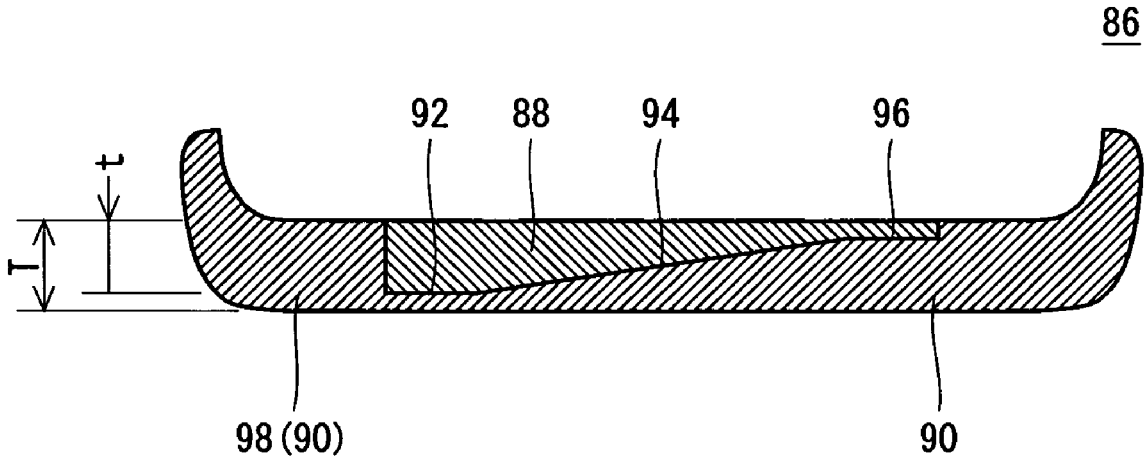
FIG. 11 is a cross-sectional view showing a midsole of a golf shoe according to yet another embodiment of the present invention.

FIG. 11 shows a cross-sectional view showing a midsole 86 of a golf shoe according to a further embodiment of the present invention. The planar shape of this midsole 86 is equal to that of the midsole 10 shown in FIG. 2. FIG. 11 shows a cross-sectional surface along the lateral line B. In FIG. 11, the left side direction indicates an inside direction and the right side direction indicates an outside direction. This midsole 86 has a low elastic part 88, a high elastic part 90, a first flat surface 92, an inclined surface 94 and a second flat surface 96. The first flat surface 92 is continuously connected to the inclined surface 94 and is located to the inside of the inclined surface 94. The second flat surface 96 is continuously connected to the inclined surface 94 and is located to the outside of the inclined surface 94. The low elastic part 88 is located to the upper side of the inclined surface 94. The low elastic part 88 is located to the inside of the inclined surface 94. The high elastic part 90 is located to the lower side of the inclined surface 94. The high elastic part 90 is located to the outside of the inclined surface 94. The low elastic part 88 is on the first flat surface 92. The high elastic part 90 is under the first flat surface 92. The low elastic part 88 is on the second flat surface 96. The high elastic part 90 is under the second flat surface 96. An inner high elastic part 98 is located to the inside of the low elastic part 88.

Also in this midsole 86, a foot is inclined due to a difference of compression deformation between the low elastic part 88 and the high elastic part 90. Through this inclination, a golf player can transfer sufficient force to the ground. Also in this midsole 86, compression deformation changes continuously from the inside to the outside along the inclined surface 94. The continuous change contributes to stability of swing. Also in this midsole 86, the inner high elastic part 90 does not absorb much of the force transferred from a foot to the ground.

In this midsole 86, the low elastic part 88 is not exposed on the bottom surface. In other words, the boundary between the low elastic part 88 and the high elastic part 90 does not exist on the bottom surface. This midsole is superior in durability. From the standpoint of durability, the ratio of the thickness t of the low elastic part 88 to the thickness T of the midsole 86 is preferably less than 100%, more preferably 98% or less and particularly preferably 95% or less. From the viewpoint that the top surface of the insole is sufficiently inclined, this ratio is preferably 30% or more, more preferably 50% or more and particularly preferably 80% or more.

Figure 12:
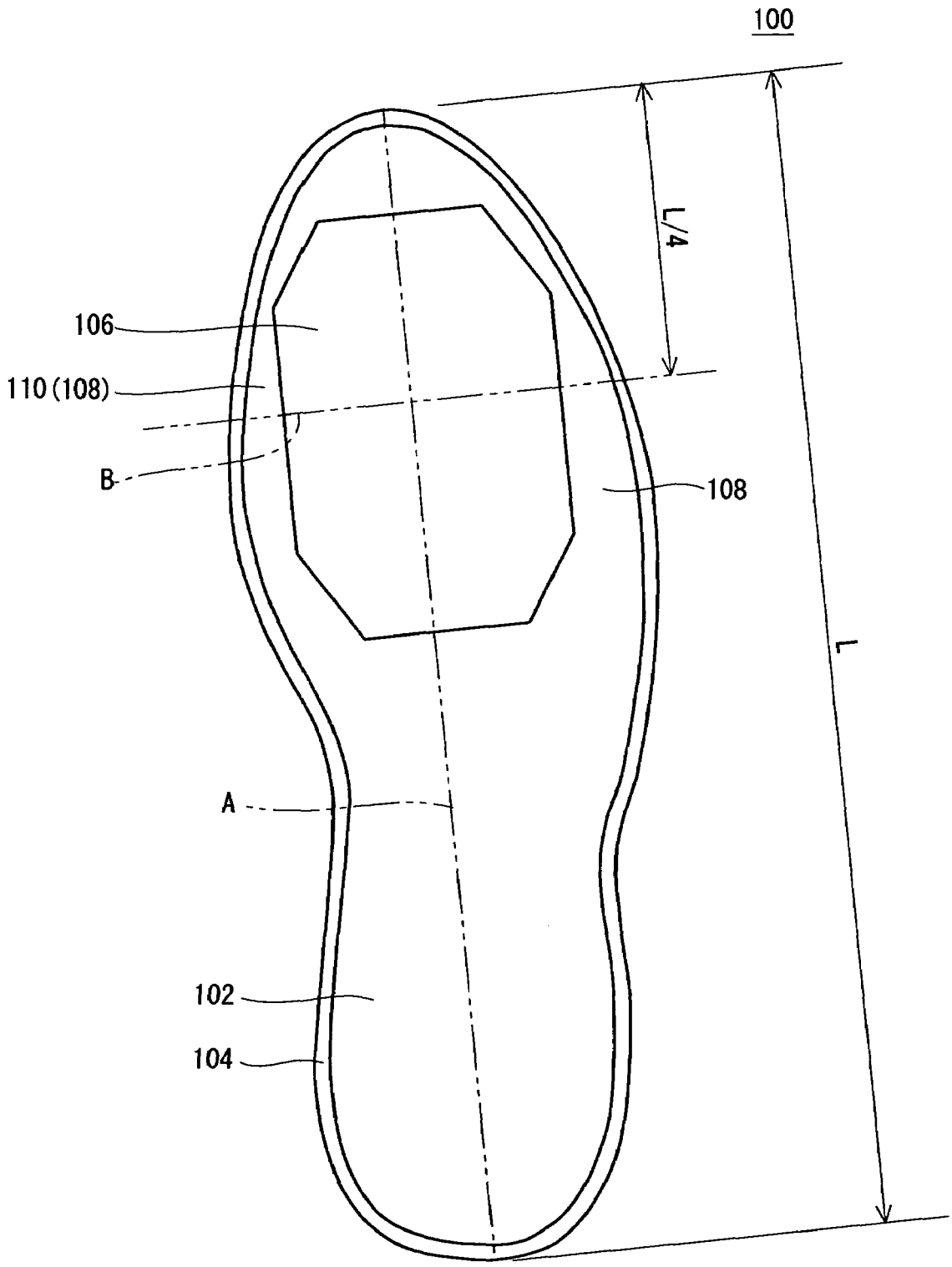
FIG. 12 is a plan view showing a midsole of a golf shoe according to a further embodiment of the present invention.

FIG. 12 is a plan view showing a midsole 100 of a golf shoe of a further embodiment of the present invention. FIG. 12 shows a longitudinal line A and a lateral line B. This midsole 100 has a base 102 and a side wall 104 located on the outer edge of this base 102. This midsole 100 is designed for a right foot. A midsole for a left foot has a mirror-reversed shape of the shape shown in FIG. 12.

The cross-sectional shape along the lateral line B of this midsole 100 is equal to that of the midsole 10 shown in FIG. 4. This midsole 100 has a low elastic part 106 and a high elastic part 108. The boundary between the low elastic part 106 and the high elastic part 108 includes an inclined surface. Also in this midsole 100, a foot is inclined due to a difference of compression deformation between the low elastic part 106 and the high elastic part 108. Through this inclination, a golf player can transfer sufficient force to the ground. Also in this midsole 100, compression deformation changes continuously from the inside to the outside along the inclined surface. The continuous change contributes to stability of swing. Also in this midsole 100, an inner high elastic part 110 does not absorb much of the force transferred from a foot to the ground.

As FIG. 12 clearly shows, the planar shape of the low elastic part 106 is octagonal. In the midsole 100 which has the octagonal low elastic part 106, compression deformation does not change rapidly in back and forth directions. The octagonal low elastic part 106 contributes to stability of swing. A low elastic part whose planar shape is hexagonal, heptagonal, enneagonal or decagonal also contributes to stability of swing.

Figure 13:
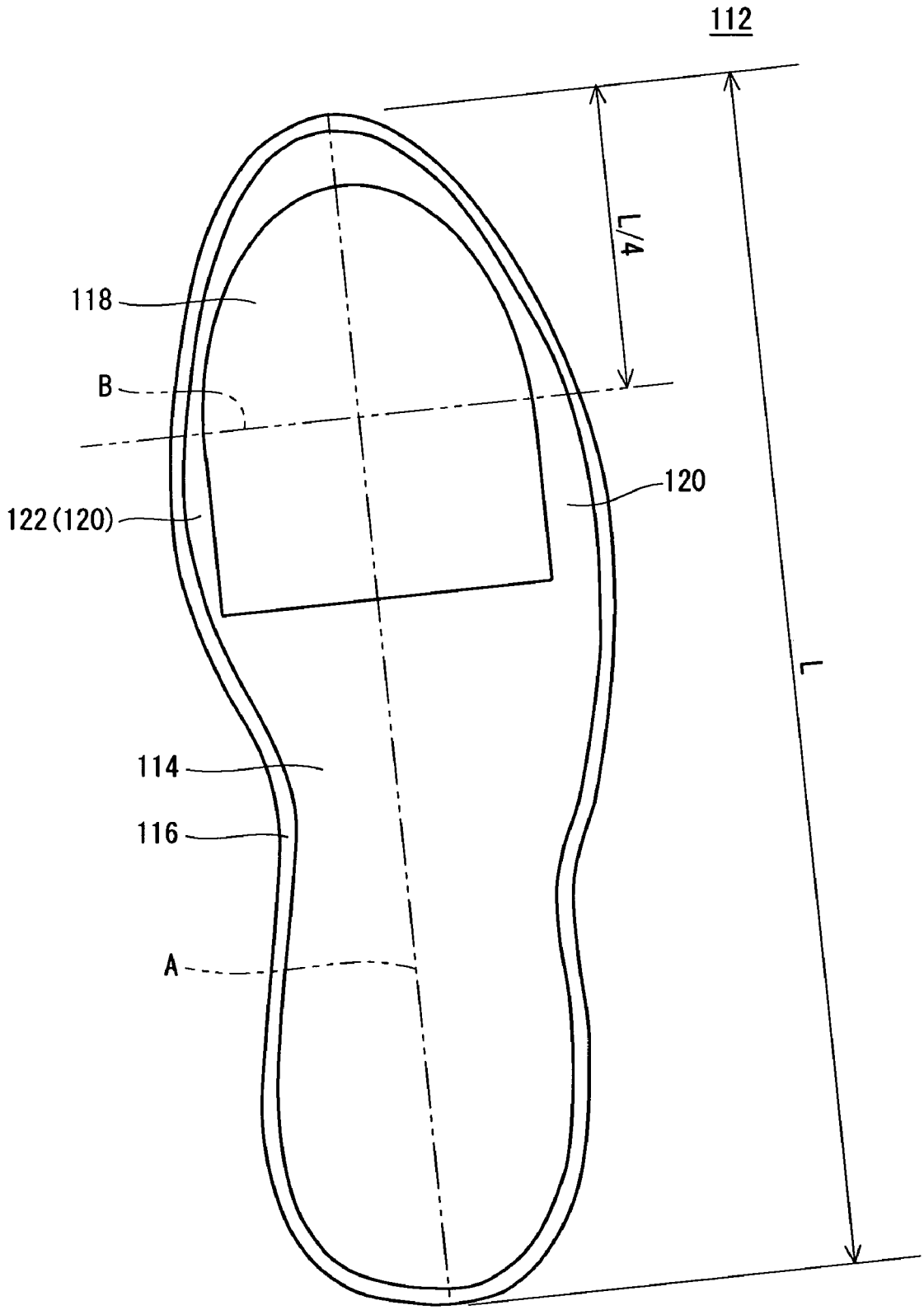
FIG. 13 is a plan view showing a midsole of a golf shoe according to a further embodiment of the present invention.

FIG. 13 is a plan view showing a midsole 112 of a golf shoe of a further embodiment of the present invention. FIG. 13 shows a longitudinal line A and a lateral line B. This midsole 112 has a base 114 and a side wall 116 located on the outer edge of this base 114. This midsole 112 is designed for a right foot. A midsole for a left foot has a mirror-reversed shape of the shape shown in FIG. 13.

The cross-sectional shape along the lateral line B of this midsole 112 is equal to that of the midsole 10 shown in FIG. 4. This midsole 112 has a low elastic part 118 and a high elastic part 120. The boundary between the low elastic part 118 and the high elastic part 120 includes an inclined surface. The planar shape of the low elastic part 118 is an almost semi-ellipse. Also in this midsole 112, a foot is inclined due to a difference of compression deformation between the low elastic part 118 and the high elastic part 120. Through this inclination, a golf player can transfer sufficient force to the ground. Also in this midsole 112, compression deformation changes continuously from the inside to the outside along the inclined surface. The continuous change contributes to stability of swing. Also in this midsole 112, the inner high elastic part 122 does not absorb much of the force transferred from a foot to the ground.

Figure 14:
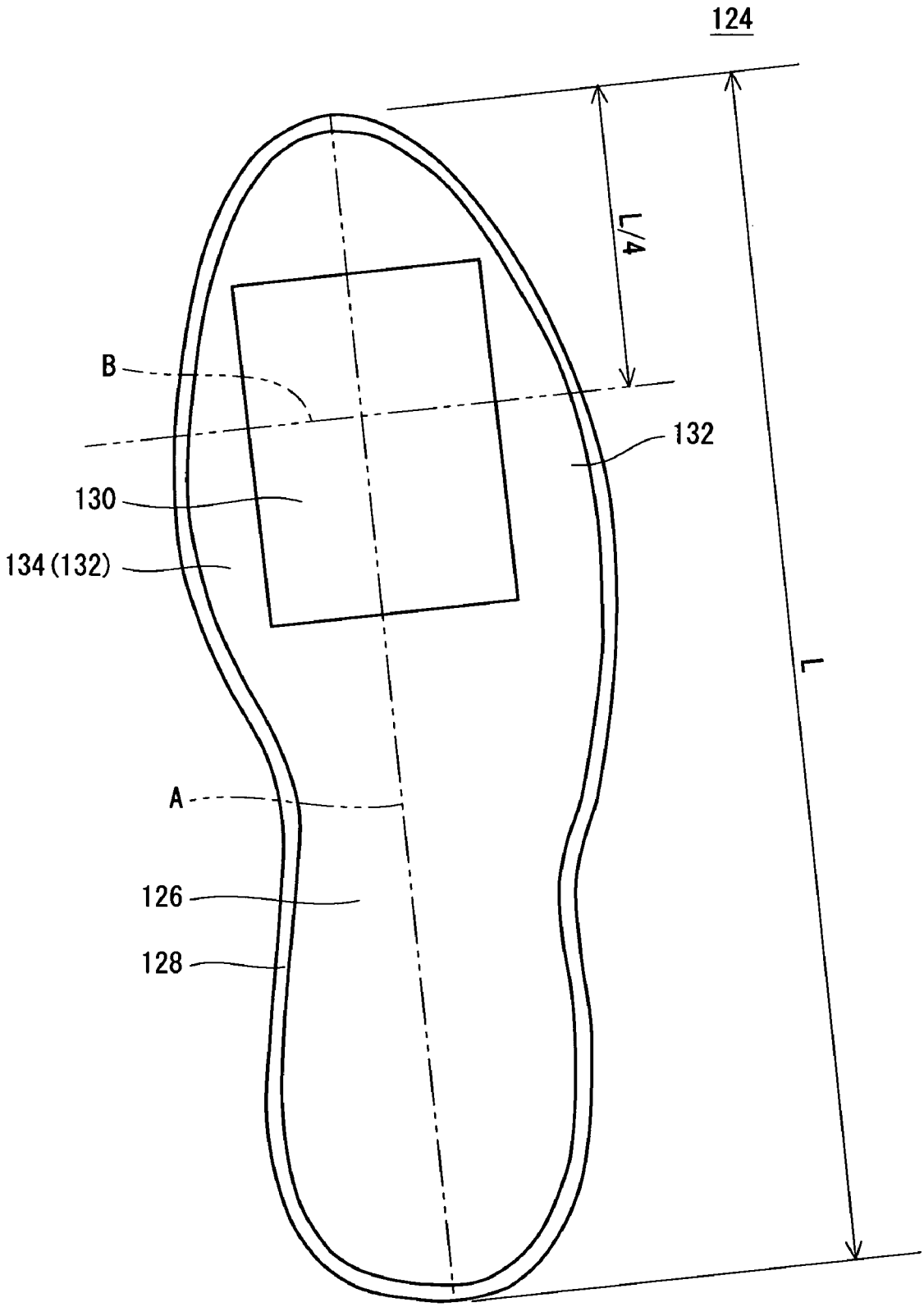
FIG. 14 is a plan view showing a midsole of a golf shoe according to a further embodiment of the present invention.

FIG. 14 is a plan view showing a midsole 124 of a golf shoe of a further embodiment of the present invention. FIG. 14 shows a longitudinal line A and a lateral line B. This midsole 124 has a base 126 and a side wall 128 located on the outer edge of this base 126. This midsole 124 is designed for a right foot. A midsole for a left foot has a mirror-reversed shape of the shape shown in FIG. 14.

The cross-sectional shape along the lateral line B of this midsole 124 is equal to that of the midsole 10 shown in FIG. 4. This midsole 124 has a low elastic part 130 and a high elastic part 132. The boundary between the low elastic part 130 and the high elastic part 132 includes an inclined surface. The planar shape of the low elastic part 130 is oblong. Also in this midsole 124, a foot is inclined due to a difference of compression deformation between the low elastic part 130 and the high elastic part 132. Through this inclination, a golf player can transfer sufficient force to the ground. Also in this midsole 124, compression deformation changes continuously from the inside to the outside along the inclined surface. The continuous change contributes to stability of swing. Also in this midsole 124, an inner high elastic part 134 does not absorb much of the force transferred from a foot to the ground.

EXAMPLES

Example 1

A midsole which has a cross-sectional shape shown in FIG. 8 was made. In this midsole, the length L is 290 mm, the width W is 100 mm and the thickness T is 6 mm. This midsole has a low elastic part and a high elastic part. The boundary between the low elastic part and the high elastic part includes an inclined surface. A width Wa of the inclined surface is 50 mm. The high elastic part includes an inner high elastic part. A width Wb of the inner high elastic part is 15 mm. In this midsole, the ratio of the thickness t to the thickness T is 100%. By providing this midsole with an outsole, an insole and an upper, a golf shoe according to Example 1 was obtained.

Examples 5 and 6

By performing the same procedures as those of Example 1 except for designing the ratio of the thickness t to the thickness T as shown in the following Table 1, a golf shoe according to Examples 5 and 6 was obtained.

Examples 4 and 7

By performing the same procedures as those of Example 1 except for designing the width Wb of the inner high elastic part as shown in the following Table 1, a golf shoe according to Examples 4 and 7 was obtained. A cross-sectional view of the midsole-according to Example 7 is equal to FIG. 4.

Examples 2, 3 and 8

By performing the same procedures as those of Example 1 except for designing the width Wa of the inclined surface as shown in the following Table 1, a golf shoe according to Examples 2, 3 and 8 was obtained. A cross-sectional view of the midsole according to Example 8 is equal to FIG. 4.

Examples 9 and 10

By performing the same procedures as those of Example 1 except for changing the materials for the low elastic part and the high elastic part, a golf shoe according to Examples 9 and 10 was obtained. The hardnesses for the low elastic part and the high elastic part are shown in the following Table 1.

Example 11

Figure 15:
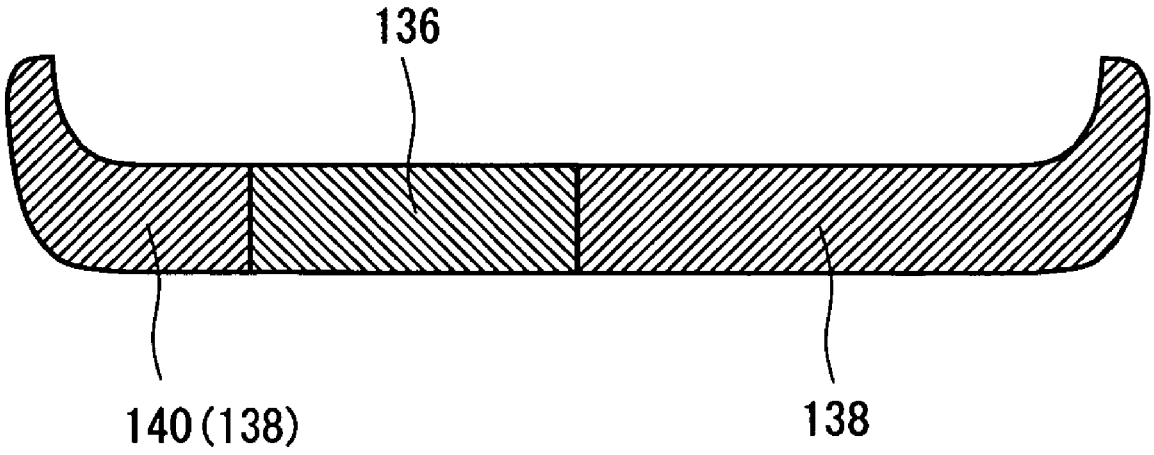
FIG. 15 is a cross-sectional view showing a midsole of a golf shoe according to Example 9 of the present invention.

By performing the same procedures as those of Example 1 except for designing a cross-sectional shape of the midsole as shown in FIG. 15, a golf shoe according to Example 11 was obtained. This midsole has a low elastic part 136 and a high elastic part 138. The boundary between the low elastic part 136 and the high elastic part 138 is perpendicularly extended. The high elastic part 138 includes an inner high elastic part 140.

Comparative Example

Figure 16:
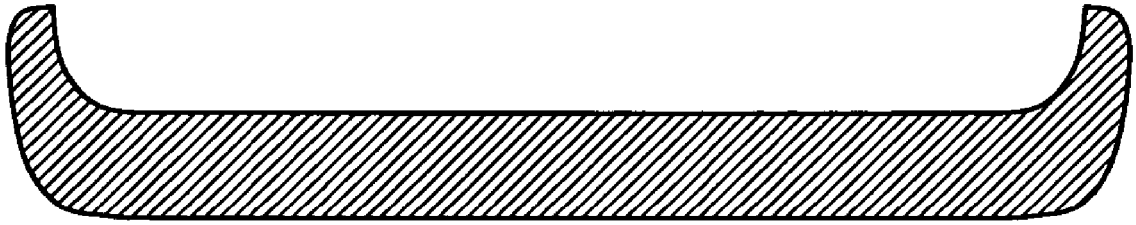
FIG. 16 is a cross-sectional view showing a midsole of a golf shoe according to a comparative example.

By performing the same procedures as those of Example 1 except for designing a cross-sectional shape of the midsole as shown in FIG. 16, a golf shoe according to Comparative Example was obtained. This midsole consists of only a high elastic part.

[Impact Test]

A golf player wearing the golf shoes hit a gold ball 10 times with a driver. A head speed, flight distance, variation in flight distance, variation in face angle and variation in flight direction were measured. These results are shown in the following Table 1. In this Table 1, the value of the head speed and flight distance is an average value.

TABLE 1

| | Evaluation results | | | | | | | | | | | |
|---|---|---|---|---|---|---|---|---|---|---|---|---|
| | Example 2 | Example 3 | Example 4 | Example 5 | Example 6 | Example 1 | Example 7 | Example 8 | Example 9 | Example 10 | Example 11 | Compa. Example |
| Lateral cross-section | FIG. 8 | FIG. 8 | FIG. 8 | FIG. 10 | FIG. 10 | FIG. 8 | FIG. 4 | FIG. 4 | FIG. 8 | FIG. 8 | FIG. 15 | FIG. 16 |
| Width Wa (mm) | 5 | 30 | 50 | 30 | 50 | 50 | 50 | 70 | 50 | 50 | 0 | — |
| Width Wb (mm) | 15 | 15 | 5 | 15 | 15 | 15 | 25 | 15 | 15 | 15 | 15 | — |
| Width Wc (mm) | 25 | 25 | 15 | 25 | 25 | 25 | 35 | 25 | 25 | 25 | 25 | — |
| (t/T) * 100 (%) | 100 | 100 | 100 | 40 | 80 | 100 | 100 | 100 | 100 | 100 | 100 | — |
| Angle θ (degree) | 50 | 11 | 7 | 5 | 6 | 7 | 7 | 5 | 7 | 7 | 90 | — |
| Hardness HL (Asker C) | 40 | 40 | 40 | 40 | 40 | 40 | 40 | 40 | 30 | 56 | 40 | — |

TABLE 1-continued

| | Evaluation results | | | | | | | | | | | |
|---|---|---|---|---|---|---|---|---|---|---|---|---|
| | Example 2 | Example 3 | Example 4 | Example 5 | Example 6 | Example 1 | Example 7 | Example 8 | Example 9 | Example 10 | Example 11 | Compa. Example |
| Hardness HH (Asker C) | 60 | 60 | 60 | 60 | 60 | 60 | 60 | 60 | 75 | 70 | 60 | 60 |
| HL/HH | 0.67 | 0.67 | 0.67 | 0.67 | 0.67 | 0.67 | 0.67 | 0.67 | 0.40 | 0.80 | 0.67 | — |
| Head speed (m/s) | 40.9 | 41.1 | 41.2 | 41.0 | 41.1 | 41.2 | 41.1 | 41.3 | 41.3 | 41.0 | 40.9 | 40.2 |
| Flight distance (m) | 208 | 212 | 216 | 210 | 213 | 214 | 211 | 216 | 213 | 212 | 208 | 201 |
| Variation of flight distance (m) | 27 | 26 | 24 | 23 | 22 | 21 | 25 | 20 | 23 | 22 | 29 | 26 |
| Variation of face angle (degree) | 5 | 4 | 5 | 4 | 4 | 3 | 4 | 3 | 5 | 4 | 7 | 6 |
| Variation of flight direction (m) | 34 | 29 | 32 | 27 | 25 | 23 | 26 | 22 | 28 | 27 | 40 | 39 |

As table 1 clearly shows, a high head speed and a large flight distance can be obtained by using the golf shoe according to Examples. Particularly, the golf shoe according to Example 1 to Example 10 contributes to flight distance and stability of flight direction. These evaluation results clearly show the advantage of this invention.

A shoe which enables a foot to be inclined is also suitable for various sports. The above-mentioned explanations are only illustrative and various arrangements within the scope of the present invention can be made.

What is claimed is:

1. A shoe comprising a bottom part including a midsole, the midsole having a low elastic part, a high elastic part with an elastic modulus higher than that of the low elastic part, and an inclined surface defining a laterally inclined boundary therebetween, wherein the low elastic part has a thickness that increases laterally from the outside towards the inside of the inclined surface and an outer boundary that does not extend to any peripheral edge of the midsole, and the high elastic part has a thickness that increases laterally from the inside towards the outside of the inclined surface and an outer boundary that defines an outer peripheral boundary of the midsole.

2. The shoe according to claim 1, wherein the low elastic part extends laterally from the outside to a remaining portion short of the inside lateral end of the midsole, and wherein the remaining portion comprises an inner high elastic part.

3. The shoe according to claim 1, wherein the inclined surface is located at a longitudinal line across the midsole at a distance 25% from a toe end towards a heel end.

4. The shoe according to claim 1, wherein the inclined surface has lateral width of 5 mm or more and 100 mm or less.

5. The shoe according to claim 1, wherein a maximum thickness of the low elastic part along the inclined surface is 30% or more of the thickness of the midsole.

6. The shoe according to claim 1, wherein a ratio (HL/HH) of hardness HL of the low elastic part to hardness HH of the high elastic part is 0.20 or more and 0.90 or less.

7. The shoe according to claim 1, wherein the shoe is a golf shoe.

8. A shoe comprising a bottom part including a midsole, the midsole having a low elastic part, a high elastic part and an inclined surface defining a laterally inclined boundary therebetween, wherein the low elastic part has a thickness that increases laterally from the outside towards the inside of the inclined surface and has a maximum thickness t, the high elastic part has a thickness that increases laterally from the inside towards the outside of the inclined surface and has a maximum thickness T, and the ratio of t to T is less than 100%.

9. A shoe comprising a bottom part including a midsole, the midsole having a low elastic part, a high elastic part and an inclined surface defining a laterally inclined boundary therebetween, wherein the low elastic part has a thickness that increases laterally from the outside towards the inside of the inclined surface, the high elastic part has a thickness that increases laterally from the inside towards the outside of the inclined surface, the low elastic part extends laterally from the outside to a remaining portion short of the inside lateral end of the midsole, and the remaining portion comprises an inner high elastic part.

10. The shoe according to claim 9, wherein the shoe is a golf shoe.

11. The shoe according to claim 9, wherein the low elastic part extends laterally from the outside to a remaining portion short of the inside lateral end of the midsole, and wherein the remaining portion comprises an inner high elastic part.

12. The shoe according to claim 9, wherein the inclined surface is located at a longitudinal line across the midsole at a distance 25% from a toe end towards a heel end.

13. The shoe according to claim 9, wherein the inclined surface has a lateral width of 5 mm or more and 100 mm or less.

14. The shoe according to claim 9, wherein a maximum thickness of the low elastic part along the inclined surface is 30% or more of the thickness of the midsole.

15. The shoe according to claim 9, wherein a ratio (HL/HH) of hardness HL of the low elastic part to hardness HH of the high elastic part is 0.20 or more and 0.90 or less.

16. A shoe comprising a bottom part, wherein downward displacement of an inside lateral portion of a top surface of the bottom part is larger than downward displacement of an outside lateral portion of the top surface, when the body weight of a wearer is applied to the top surface, the bottom part includes a midsole having a low elastic part, a high elastic part and a surface defining a lateral boundary therebetween, the low elastic part has a maximum thickness t, the high elastic part has a maximum thickness T, and the ratio of t to T is less than 100%.

* * * * *